US007607652B2

(12) United States Patent
Kushida

(10) Patent No.: US 7,607,652 B2
(45) Date of Patent: Oct. 27, 2009

(54) SHEET PROCESSING APPARATUS AND IMAGE FORMING APPARATUS

(75) Inventor: Hideki Kushida, Moriya (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 12/349,799

(22) Filed: Jan. 7, 2009

(65) Prior Publication Data

US 2009/0115118 A1 May 7, 2009

Related U.S. Application Data

(63) Continuation of application No. 12/119,913, filed on May 13, 2008, now Pat. No. 7,490,822, which is a continuation of application No. 11/562,038, filed on Nov. 21, 2006, now Pat. No. 7,389,980.

(30) Foreign Application Priority Data

Dec. 1, 2005 (JP) ..... 2005-348548
Oct. 2, 2006 (JP) ..... 2006-270798

(51) Int. Cl.
*B65H 37/04* (2006.01)

(52) U.S. Cl. ..... 270/58.12; 270/58.16; 270/58.17; 270/58.27

(58) Field of Classification Search ..... 270/58.12, 270/58.16, 58.17, 58.27
See application file for complete search history.

(56) References Cited

U.S. PATENT DOCUMENTS

| | | | |
|---|---|---|---|
| 6,047,960 | A | 4/2000 | Kawano et al. |
| 6,102,385 | A | 8/2000 | Wakamatsu et al. |
| 2007/0075482 | A1 | 4/2007 | Fujita et al. |
| 2007/0145661 | A1 | 6/2007 | Ichikawa |

FOREIGN PATENT DOCUMENTS

| | | | |
|---|---|---|---|
| JP | 6-133459 | A | 5/1994 |
| JP | 11-349234 | A | 12/1999 |

*Primary Examiner*—Gene Crawford
*Assistant Examiner*—Leslie A Nicholson, III
(74) *Attorney, Agent, or Firm*—Rossi, Kimms & McDowell LLP

(57) ABSTRACT

A sheet processing apparatus has: a plurality of conveying paths which convey sheets; and front and back aligning members which perform width alignment in the direction which crosses the sheet conveying direction of the sheets conveyed from the conveying paths. Standby positions when the front and back aligning members approach side edges of the sheets from the standby positions and perform the width alignment of the sheets at the width aligning position are made different every sheet on the basis of discharge position information of the sheets to the plurality of conveying paths.

15 Claims, 15 Drawing Sheets

SHEET PROCESSING APPARATUS AND IMAGE FORMING APPARATUS

This is a continuation of U.S. patent application Ser. No. 12/119,913 filed May 13, 2008 which is a continuation of U.S. patent application Ser. No. 11/562,038 filed Nov. 21, 2006, now U.S. Pat. No. 7,389,980 B2 issued Jun. 24, 2008. The contents of each are incorporated herein by reference.

BACKGROUND OF THE INVENTION

1. Field of the Invention

The invention relates to a sheet processing apparatus for aligning sheets in the direction which crosses a sheet conveying direction of the sheets and an image forming apparatus having such a sheet processing apparatus. More particularly, the invention relates to a sheet processing apparatus in which even if there are a plurality of conveying paths to which sheets are fed, it can cope with the sheets in a short processing time and relates to an image forming apparatus having such a sheet processing apparatus.

2. Description of the Related Art

In recent years, among image forming apparatuses such as printer, copying apparatus, facsimile apparatus, their multifunction apparatus, and the like for forming images onto sheets, there is an image forming apparatus having a sheet processing apparatus for ejecting the sheets in a form of a bundle. As such a sheet processing apparatus, for example, there is a sheet sorting apparatus as disclosed in Japanese Patent Application Laid-Open No. S61-33459.

According to such a sheet sorting apparatus, en the sheets are ejected, they are alternately sorted and stacked in a form of a bundle (offset-stacking), thereby enabling the sheet bundles to be clearly distinguished. FIG. 15A and FIG. 15B are schematic diagrams of the sheet sorting apparatus disclosed in Japanese Patent Application Laid-Open No. S61-33459.

According to a sheet sorting apparatus 1, sheets conveyed by fixing rollers 5 and fixing discharge rollers 6 are ejected by an upper roller 8 and a lower roller 7 serving as a pair of discharge rollers. After a rear edge of the sheet passed through the fixing discharge rollers 6, the upper roller 8 and the lower roller 7 are moved by a distance L in the direction which crosses a sheet ejecting direction by a plunger magnet 11, thereby ejecting the sheet to a discharge tray 9. The distance L is a distance between the sheet bundles which were alternately sorted.

A sheet sorting apparatus in which the ejected sheets are aligned by an aligning member for aligning the sheets and, at the same time, the sheets are shifted in the direction which crosses the sheet ejecting direction and ejected has also been developed.

However, according to the conventional sheet sorting apparatuses, since there is only one conveying path to which the sheets are fed, the sheets which are fed from a plurality of conveying paths cannot be ejected. Therefore, the conventional sheet sorting apparatus has such a problem that it is impossible to cope with the sheets which are fed from a plurality of positions.

In the sheet sorting apparatus for sorting the sheets by the aligning member for aligning the sheets, since the aligning member is moved in the direction which crosses the sheet ejecting direction, it takes a time.

Further, there is a case where the sheets which are fed are conveyed in the state where the position has been selected in a width direction of the sheet. However, since the position of the aligning member cannot be shunted in accordance with the selected ejecting position of the conveyed sheet, the aligning member is on standby at a position where the aligning member can align the sheets at any place. Consequently, there is a wasteful motion in the aligning member and it takes a time to align.

SUMMARY OF THE INVENTION

It is an object of the invention to provide a sheet processing apparatus in which even if there are a plurality of conveying paths to which sheets are fed, it is possible to cope with the sheets in a short processing time.

According to the invention, there is provided an image forming apparatus which has a sheet processing apparatus in which even if there are a plurality of conveying paths to which sheets are fed, it is possible to cope with the sheets in a short processing time, thereby enabling the different sheets to be processed.

According to the invention, there is provided a sheet processing apparatus comprising: a plurality of conveying paths which convey sheets; and an aligning unit which aligns the sheets in a width direction which crosses a sheet conveying direction of the sheets conveyed from the plurality of conveying paths, wherein the aligning unit has a pair of aligning members which are come into contact with side edges of the sheets from standby positions where the aligning members are arranged in the outsides of the side edges in the width direction of the sheets and align the sheets, and the standby positions are changed in accordance with each discharge position information regarding the plurality of conveying paths.

According to the sheet processing apparatus of the invention, the standby position at the time when the aligning members are come into contact with the side edges of the sheets from the standby position arranged in the outsides of the side edges in the width direction of the sheets and align the sheets is made different every sheet on the basis of the discharge position information of the sheets. Therefore, the sheet processing apparatus of the invention can cope with the plurality of conveying paths. Since it is sufficient that the distance of the movement from the standby position to the aligning position is the necessary minimum distance at the ejecting position, the sheets can be aligned in a short time.

According to the sheet processing apparatus of the invention, even in any of the sheets which have passed through a shift unit and the sheets which do not pass through the shift unit, a width of sheet can be accurately aligned to a desired position.

Further features of the present invention will become apparent from the following description of exemplary embodiments with reference to the attached drawings.

DESCRIPTION OF THE EMBODIMENT

A sheet processing apparatus in an embodiment to which the invention can be applied and an image forming apparatus having such a sheet processing apparatus will be described hereinbelow with reference to the drawings. Numerical values mentioned in the embodiment are merely reference numerical values and the invention is not limited by them.

<Image Forming Apparatus>

Figure 1:
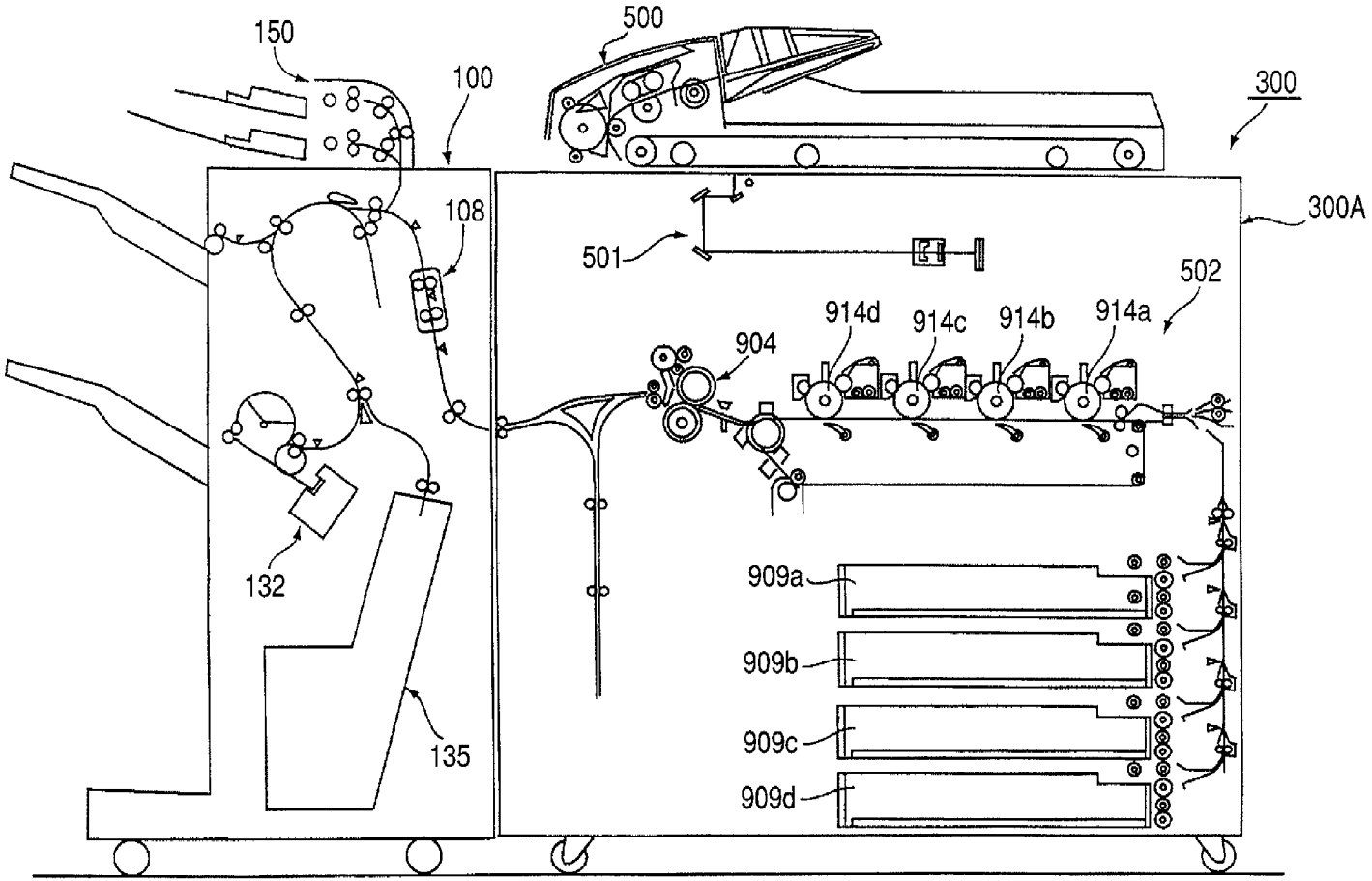
FIG. 1 is a cross sectional view taken along the sheet conveying direction of a copying apparatus as an image forming apparatus in an embodiment of the invention.

FIG. 1 is a cross sectional view taken along the sheet conveying direction of a monochromatic/color copying apparatus (hereinbelow, simply referred to as a "copying apparatus") 300 serving as an image forming apparatus in the embodiment of the invention. As image forming apparatuses, there are a copying apparatus, a printer, a facsimile apparatus, and their multi-function apparatus. The invention is not limited to the copying apparatus.

The copying apparatus 300 has: an apparatus main body 300A constructed by an image reader 501 and a printer unit 502; an automatic document feeder (ADF) 500 for feeding an original document to a position over the image reader 501; and a finisher 100 serving as a sheet processing apparatus. The finisher 100 is connected to the apparatus main body 300A of the copying apparatus and has: a saddle-stitch processing apparatus 135; and a stapler (side-stitch processing apparatus) 132. Therefore, sheets which are ejected from the apparatus main body 300A of the copying apparatus can be on-line processed. There is a case where the finisher 100 is used as an option. Therefore, the apparatus main body 300A of the copying apparatus can be also solely used. The finisher 100 and the apparatus main body 300A may be integratedly formed.

The sheet is fed from each of cassettes 909*a* to 909*d* in the apparatus main body 300A and toner images of four colors are transferred onto the sheet by an image forming portion constructed by photosensitive drums 914*a* to 914*d* for yellow, magenta, cyan, and black, developing units, and the like. The sheet is conveyed to a fixing unit 904, the toner images are fixed, and the resultant sheet is ejected to the outside of the apparatus main body 300A. According to the copying apparatus 300 of the embodiment, the center of a sheet width in the direction which crosses the sheet conveying direction and the center of the conveying path are made coincident, the sheet is conveyed, an image is formed onto the sheet in what is called a center reference state.

<Explanation of Outline of Sheet Processing Apparatus>

Figure 2:
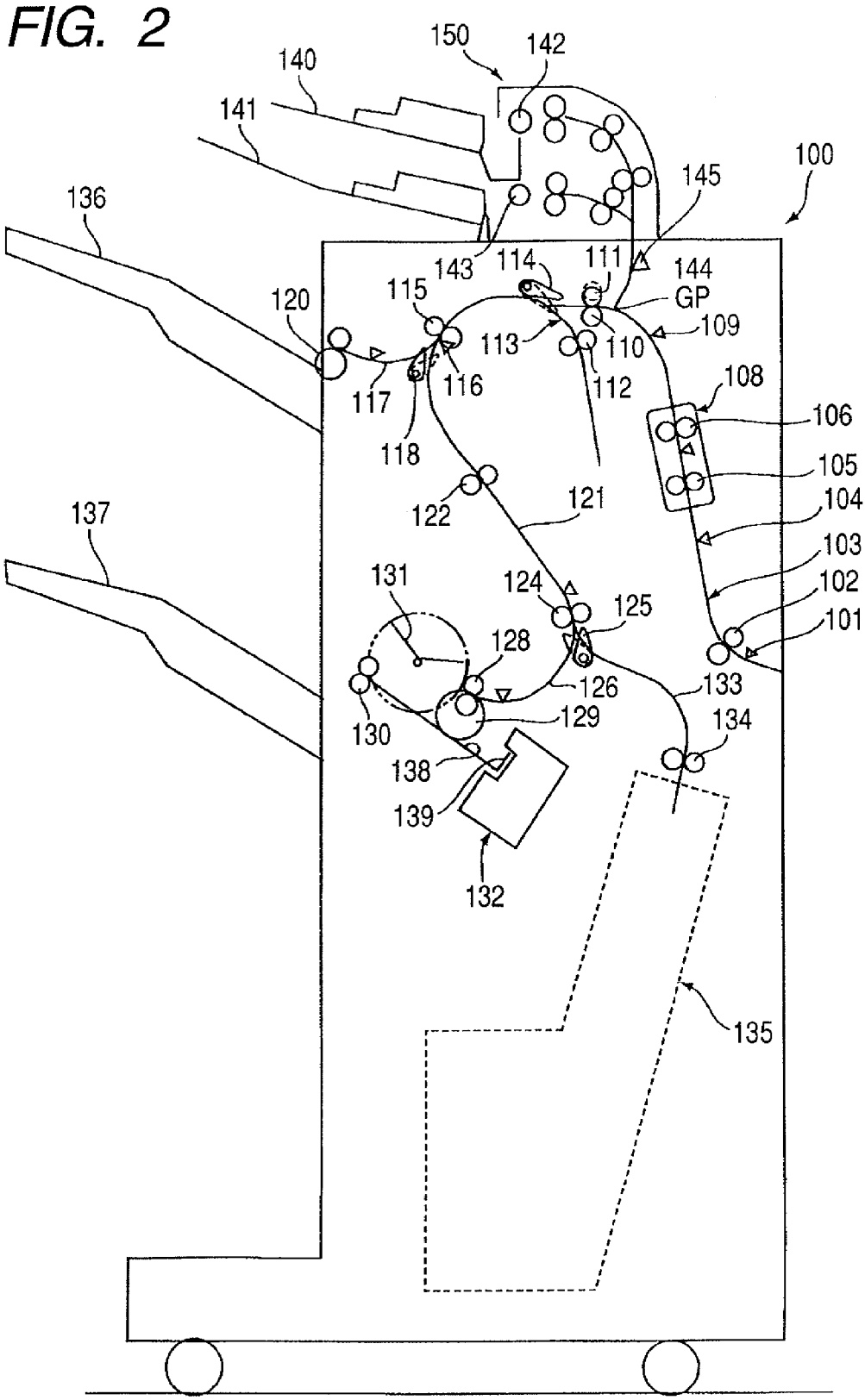
FIG. 2 is a cross sectional view taken along the sheet conveying direction of a sheet processing apparatus in the embodiment of the invention.

FIG. 2 is a cross sectional view taken along the sheet conveying direction of the finisher 100 as a sheet processing apparatus in the embodiment of the invention.

The sheet ejected from the apparatus main body 300A of the copying apparatus 300 is sent and received to a pair of inlet rollers 102 of the finisher 100. At this time, the reception timing of the sheet is also simultaneously detected by an inlet sensor 101. While the sheet conveyed to the inlet roller pair 102 passes through a conveying path 103 as a conveying path (first conveying path), a side edge position of the sheet is detected by a lateral registration detecting sensor 104. The lateral registration detecting sensor 104 detects a deviation amount of the sheet in the width direction from the center position of the finisher (that is, whether or not a lateral registration error has occurred). The width direction (lateral direction) denotes a direction which crosses the sheet conveying direction.

The lateral registration detecting sensor 104 detects the lateral registration error of the sheet. Subsequently, during the conveyance of the sheet to shift roller pairs 105 and 106, since a shift unit 108 as moving means is moved to the front side or the back side by a predetermined amount, so that the sheet is shifted and moved. The shifting operation of the shift unit 108 will be explained hereinafter.

After that, the sheet is conveyed by a conveying roller 110, a separating roller 111, and a pair of intermediate buffer rollers 115. When the sheet is ejected onto an upper tray 136, an upper path change-over flapper 118 is moved to a position shown by a broken line in the diagram by a driving source such as a solenoid or the like (not shown). After the sheet was guided to an upper conveying path 117 by a guide of the upper path change-over flapper 118, it is ejected onto the upper tray 136 by an upper discharge roller 120.

The sheet which is saddle-processed without being ejected onto the upper tray 136 or the sheet which is ejected onto a lower tray 137 is conveyed by the intermediate buffer roller pair 115 and, thereafter, guided to a bundle conveying path 121 as a conveying path (second conveying path) by the upper path change-over flapper 118. The saddle process denotes the saddle-stitch process. After that, the sheet is sequentially conveyed on the bundle conveying path 121 by a pair of downstream buffer rollers 122 and a pair of bundle conveying rollers 124.

In the case where the sheet is a sheet to be saddle-processed, a saddle path change-over flapper 125 is switched to a position shown by a broken line in the diagram by a driving source such as a solenoid or the like (not shown), thereby guiding the sheet to a saddle path 133. After that, the sheet is guided to the saddle unit 135 by a pair of saddle inlet rollers 134. Finally, the sheet is saddle-processed by the saddle unit 135. Since the saddle process is a general process and is not a main part of the invention, its detailed explanation is omitted.

In the case where the sheets sequentially conveyed on the bundle conveying path 121 are bound by the stapler 132, the saddle path change-over flapper 125 is switched to a position shown by a solid line in the diagram by the driving source such as a solenoid or the like (not shown), thereby guiding the sheets to a lower path 126. After that, the sheets are ejected onto an intermediate processing tray 138 by a pair of lower discharge rollers 128. Rear edges of a predetermined number of ejected sheets are aligned on the intermediate processing tray 138 by a return apparatus such as a puddle 131, a knurled belt 129, and the like. After that, when a predetermined number of sheets are stacked onto the intermediate processing tray 138 and become a bundle of sheets, the sheet bundle is bound by the stapler 132. The bound sheet bundle is ejected onto the lower tray 137 by a pair of bundle discharge rollers 130. If the sheet bundle whose rear edges have been aligned is not bound, the sheet bundle is ejected as it is onto the lower tray 137 by the bundle discharge roller pair 130.

Figure 3:
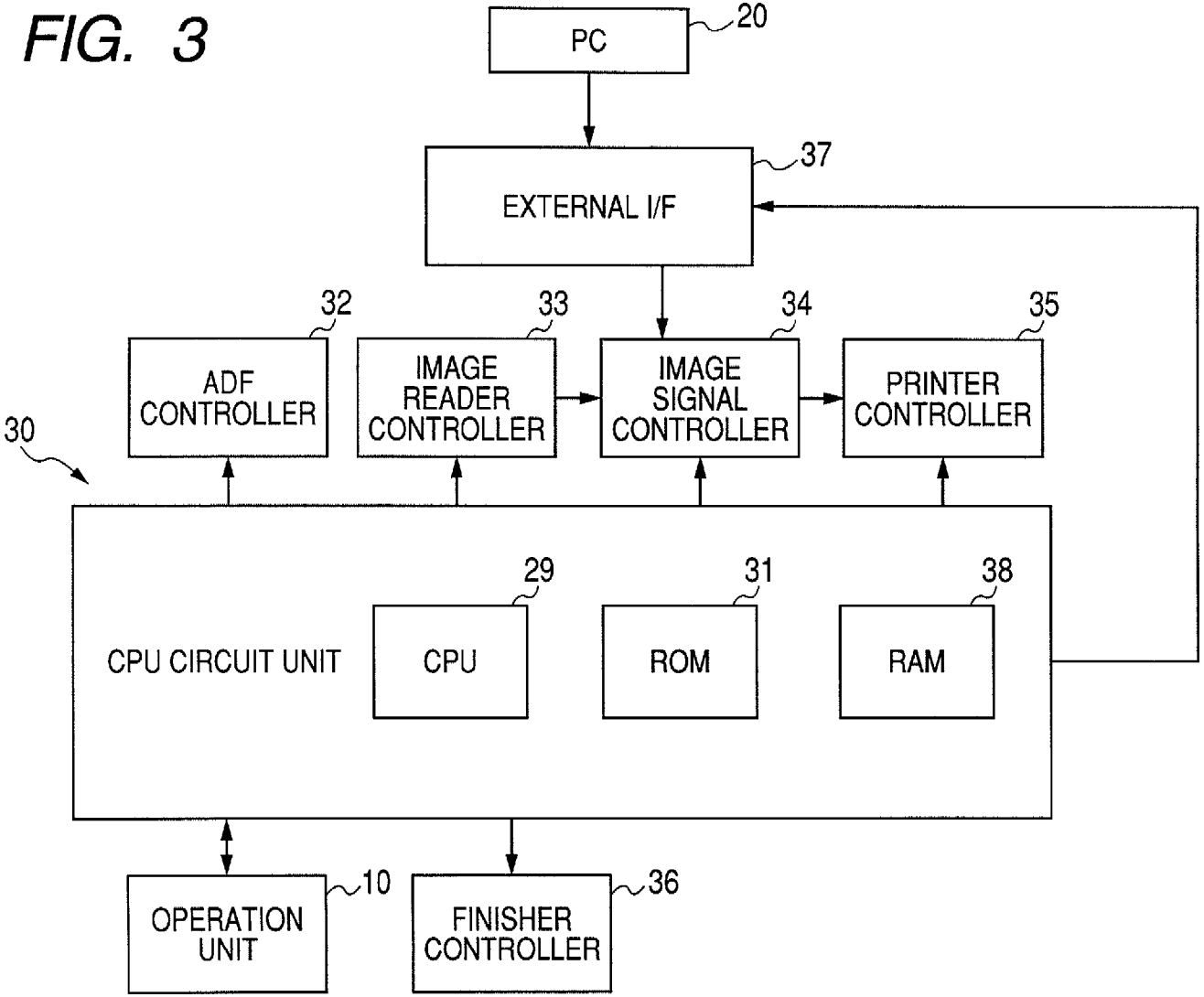
FIG. 3 is a block diagram for controlling the image forming apparatus.

FIG. 3 is a block diagram for controlling the image forming apparatus. A CPU circuit unit 30 has a CPU 29 and controls a document feeder controller (ADF controller) 32, an image reader controller 33, an image signal controller 34, a printer controller 35, a finisher controller 36, and an external interface (I/F) 37 in accordance with programs stored in a ROM 31 and settings of an operation unit 10. The ADF controller 32 controls the ADF 500. The image reader controller 33 controls the image reader 501. The printer controller 35 controls the printer unit 502. The finisher controller 36 controls the finisher 100.

A RAM 38 is used as an area for temporarily storing control data and a work area for an arithmetic operation associated with the control. The external I/F 37 is an interface with a computer (PC) 20. The external I/F 37 develops received print data into an image and outputs the image to the image signal controller 34. An image read out by the image reader 501 is outputted from the image reader controller 33 to the image signal controller 34. The image outputted from the image signal controller 34 to the printer controller 35 is inputted to an exposure controller.

Figure 4:
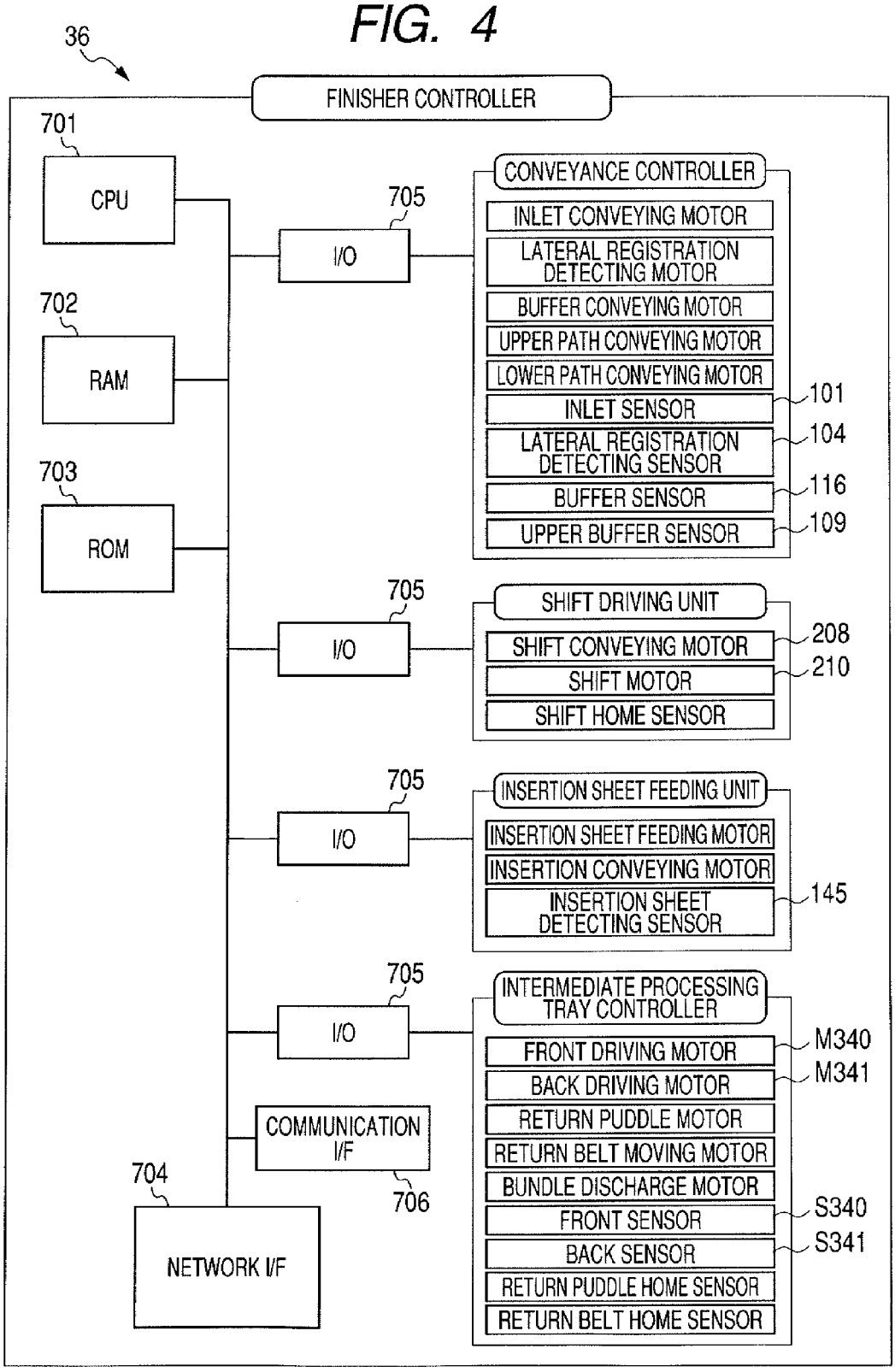
FIG. 4 is a block diagram of a finisher controller for controlling a finisher.

FIG. 4 is a block diagram of the finisher controller 36 for controlling the finisher. A control circuit is constructed by: a microcomputer (CPU) 701; a RAM 702; a ROM 703; input/output units (I/O units) 705; a communication interface (I/F) 706; a network interface (I/F) 704; and the like.

Signals of various sensors are inputted to input ports of the I/O units 705. Control blocks (not shown) and driving systems connected through various drivers (not shown) are connected to output ports of the I/O units 705, respectively.

<Description of Buffering Processing Operation>

A predetermined operation time is needed to execute the saddle process and the stapling process. Generally, the operation time is longer than a time interval of the sheets which are sequentially fed from the apparatus main body 300A of the copying apparatus although it depends on an image forming speed of the copying apparatus. Therefore, in order to make the finisher 100 execute the sheet process without stopping the operation of the apparatus main body 300A of the copying apparatus, a process (buffering process) for temporarily holding the sheets which are sequentially fed from the apparatus main body 300A is necessary. By executing the buffering process to a predetermined number of sheets from the head sheet of the subsequent sheet bundle while the sheet process is executed to the precedent sheet bundle, a sheet processing time of the precedent sheet bundle is assured. Thus, there is no need to stop the operation of the apparatus main body 300A of the copying apparatus.

The buffering process will be explained.

Figure 5A:
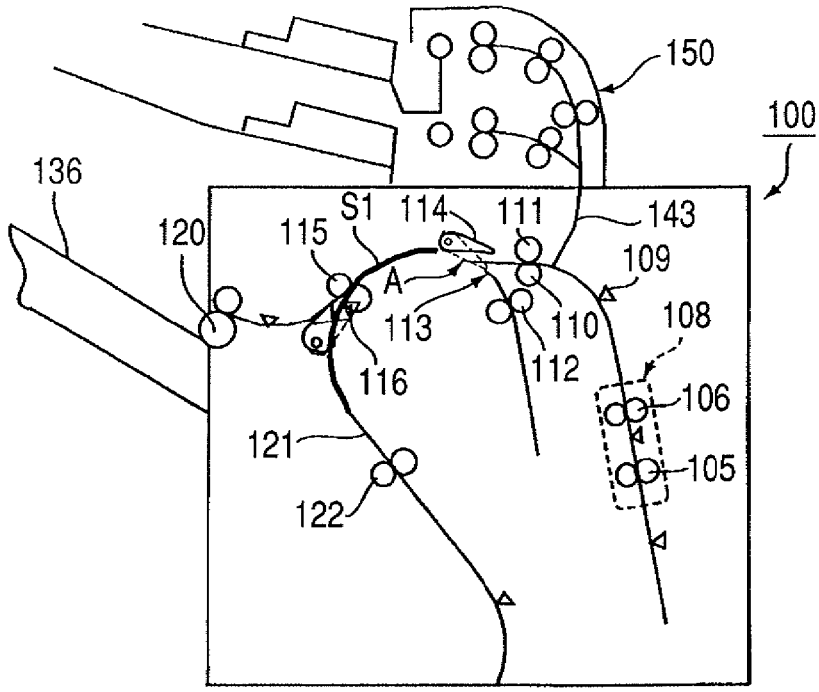
FIG. 5A is a diagram for explaining the buffer operation in the case where the first sheet has been fed to the sheet processing apparatus in FIG. 2.

As shown in FIG. 5A, a sheet S1 conveyed by the conveying roller 110 and the separating roller 111 is guided to the bundle conveying path 121 by the intermediate buffer roller pair 115. After a front edge of the sheet S1 was detected by a buffer sensor 116, when a rear edge of the sheet reaches a point A on the basis of size information of the sheet which has previously been recognized, the intermediate buffer roller pair 115 is stopped by a driving source (not shown). Thus, the sheet S1 is stopped.

Figure 5B:
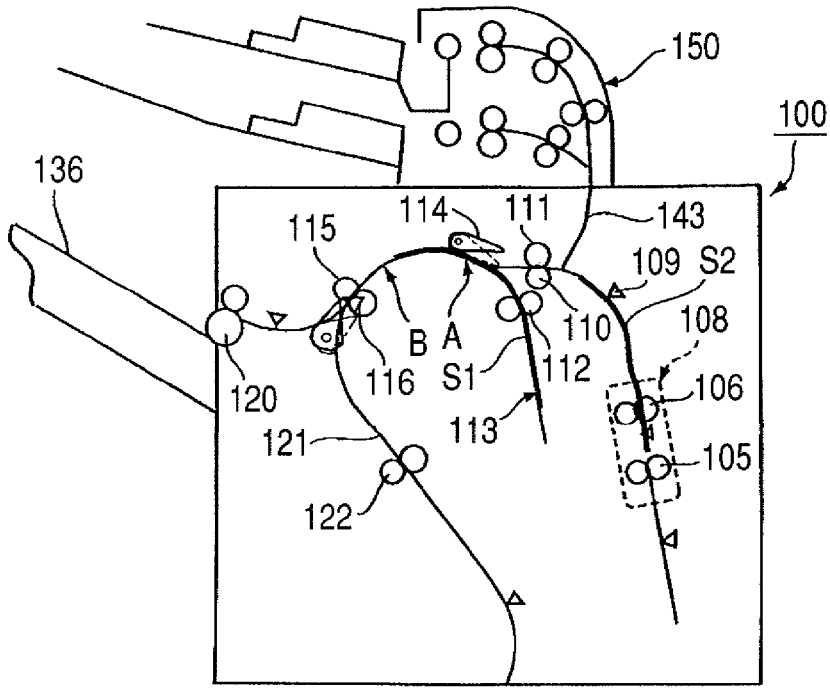
FIG. 5B is a diagram for explaining the buffer operation in the case where the second sheet has been fed to the sheet processing apparatus in FIG. 2.

After that, a buffer path change-over flapper 114 is inclined to a position shown by a broken line in the diagram by the driving source such as a solenoid or the like (not shown) and the intermediate buffer roller pair 115 is reversely rotated. Thus, the sheet is reversely conveyed and the rear edge (right edge in FIGS. 5A and 5B) is guided to a buffer path 113. After that, the sheet S1 is reversely conveyed until the front edge (left edge in FIGS. 5A and 5B) reaches a point B (refer to FIG. 5B).

Figure 6:
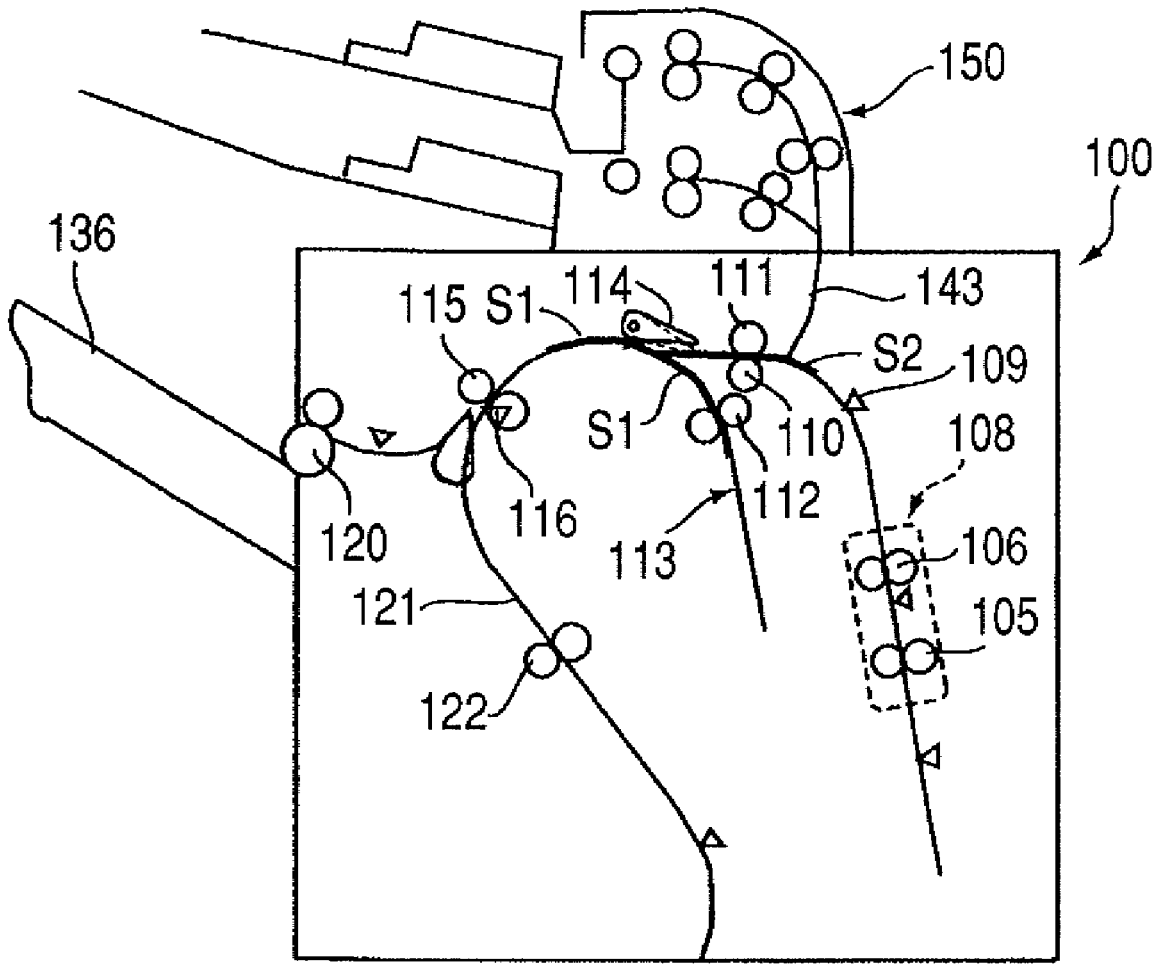
FIG. 6 is a diagram for explaining the buffer operation in the sheet processing apparatus in FIG. 2 and shows the state where the first sheet and the second sheet overlap each other.

Subsequently, after a front edge of a subsequent conveyed sheet S2 was detected by an upstream buffer sensor 109, a pair of upstream buffer rollers 112 start the driving so that the front edge of the subsequent sheet S2 comes to the same position as that of the sheet S1 in the state where the stopped sheet S1 has reached a conveying speed. Thus, the front edges of the sheets S1 and S2 are aligned (refer to FIG. 6).

In the case of overlapping further another sheet, the intermediate buffer roller pair 115 is reversely rotated until the rear edges (right edges in FIGS. 5A and 5B) of the sheets S1 and S2 reach the point A. After that, by repeating the processes mentioned above, one sheet can be further overlaid.

After a predetermined number of sheets were overlaid so as to become a sheet bundle, the downstream buffer roller pair 122 and the bundle conveying roller pair 124 convey the sheet bundle to the saddle unit 135 or the stapler 132.

<Explanation of Shift Unit>

A construction and the operation of the shift unit 108 will now be described with reference to FIGS. 7 and 8.

Figure 7:
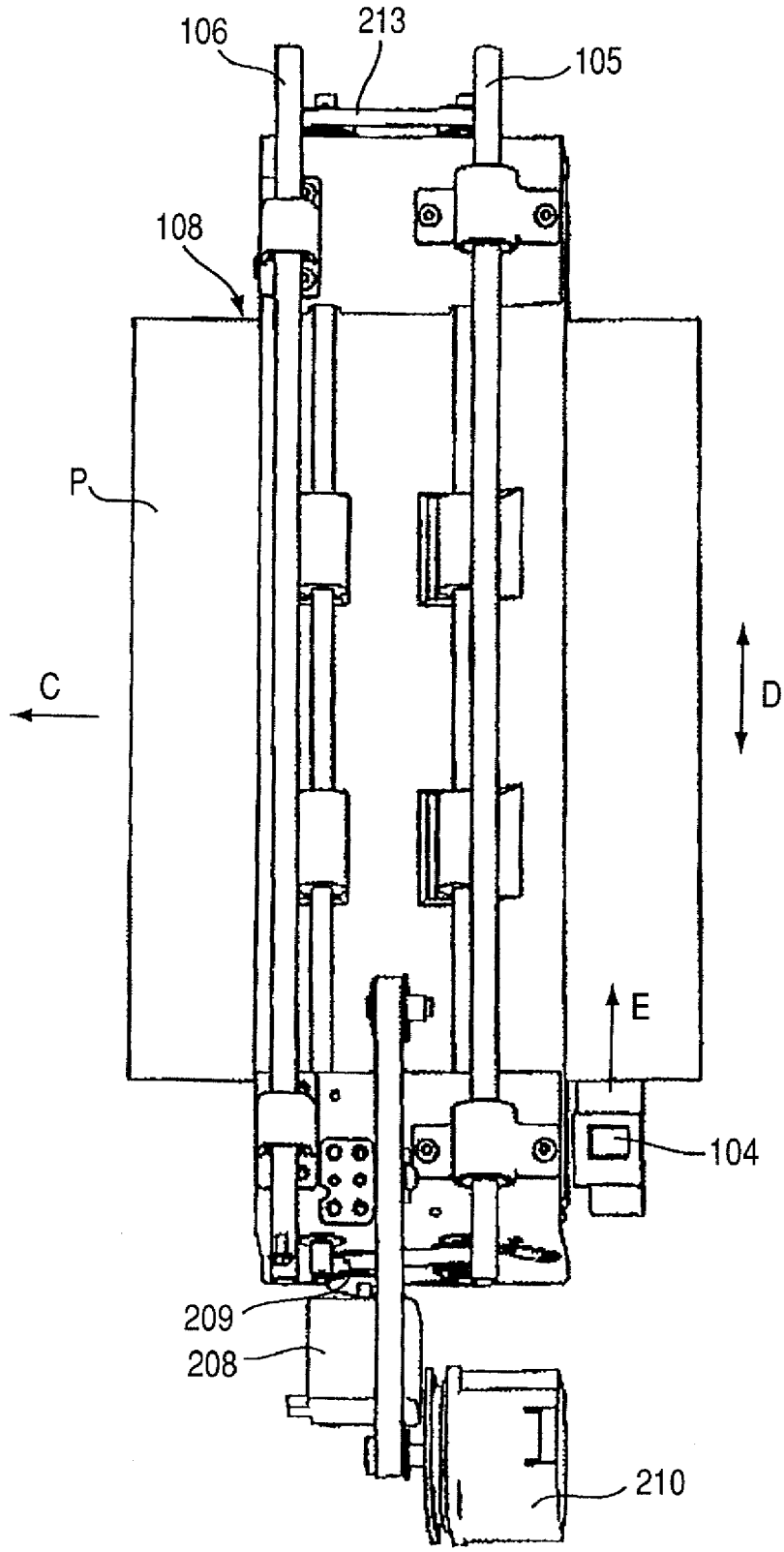
FIG. 7 is a diagram when a shift unit is seen from an upstream side of the sheet conveying direction.
Figure 8:
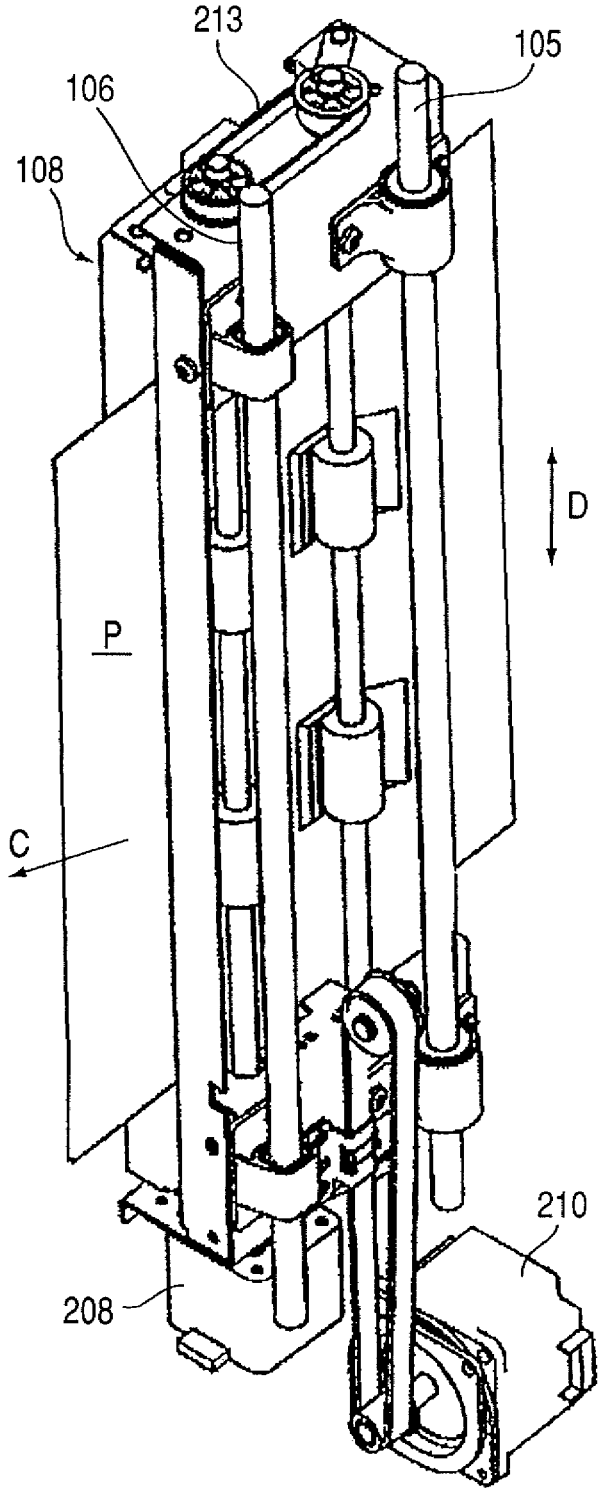
FIG. 8 is a perspective view of the shift unit.
Figure 9:
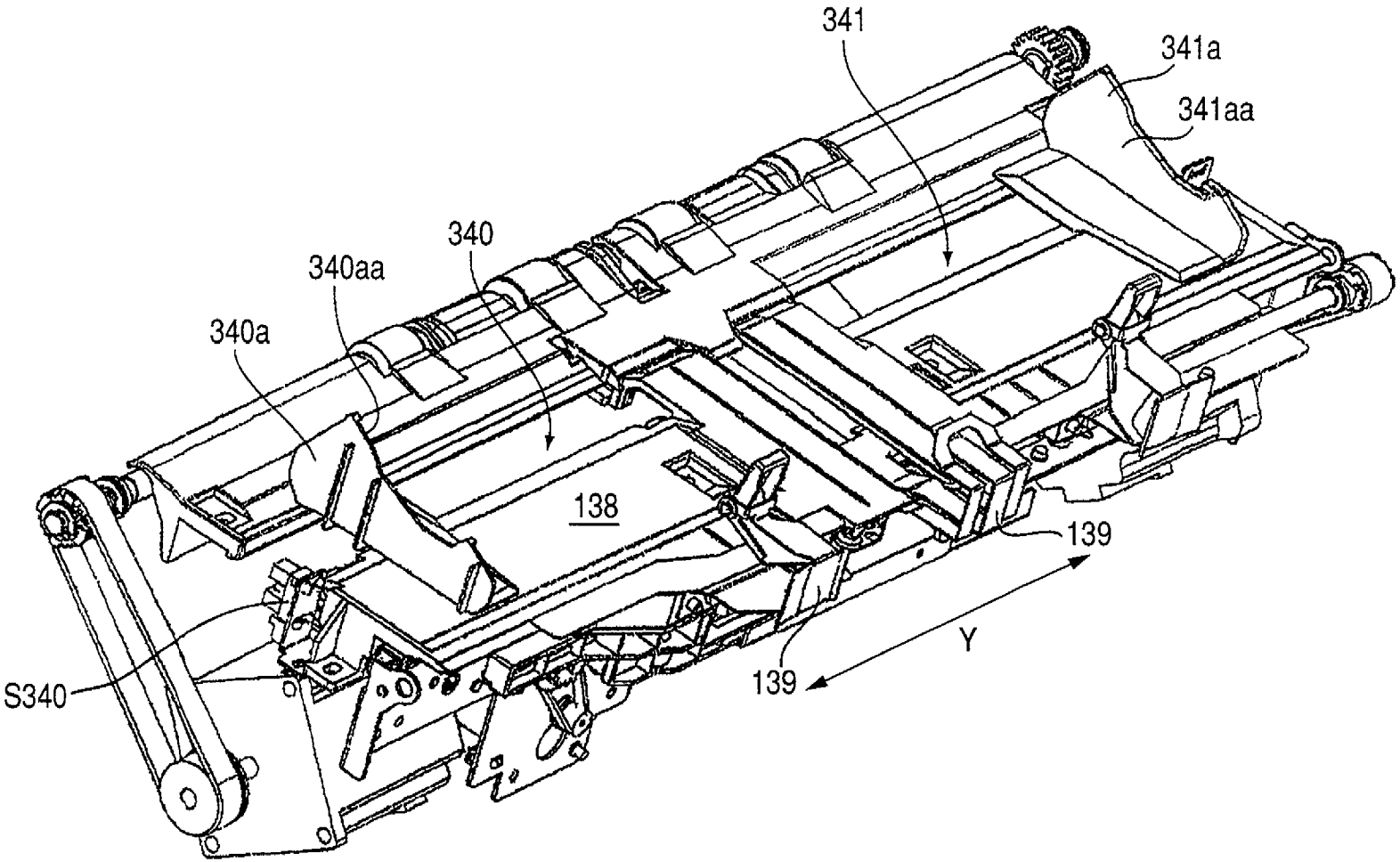
FIG. 9 is a perspective view of an intermediate processing tray having a front aligning member and a back aligning member.
Figure 10:
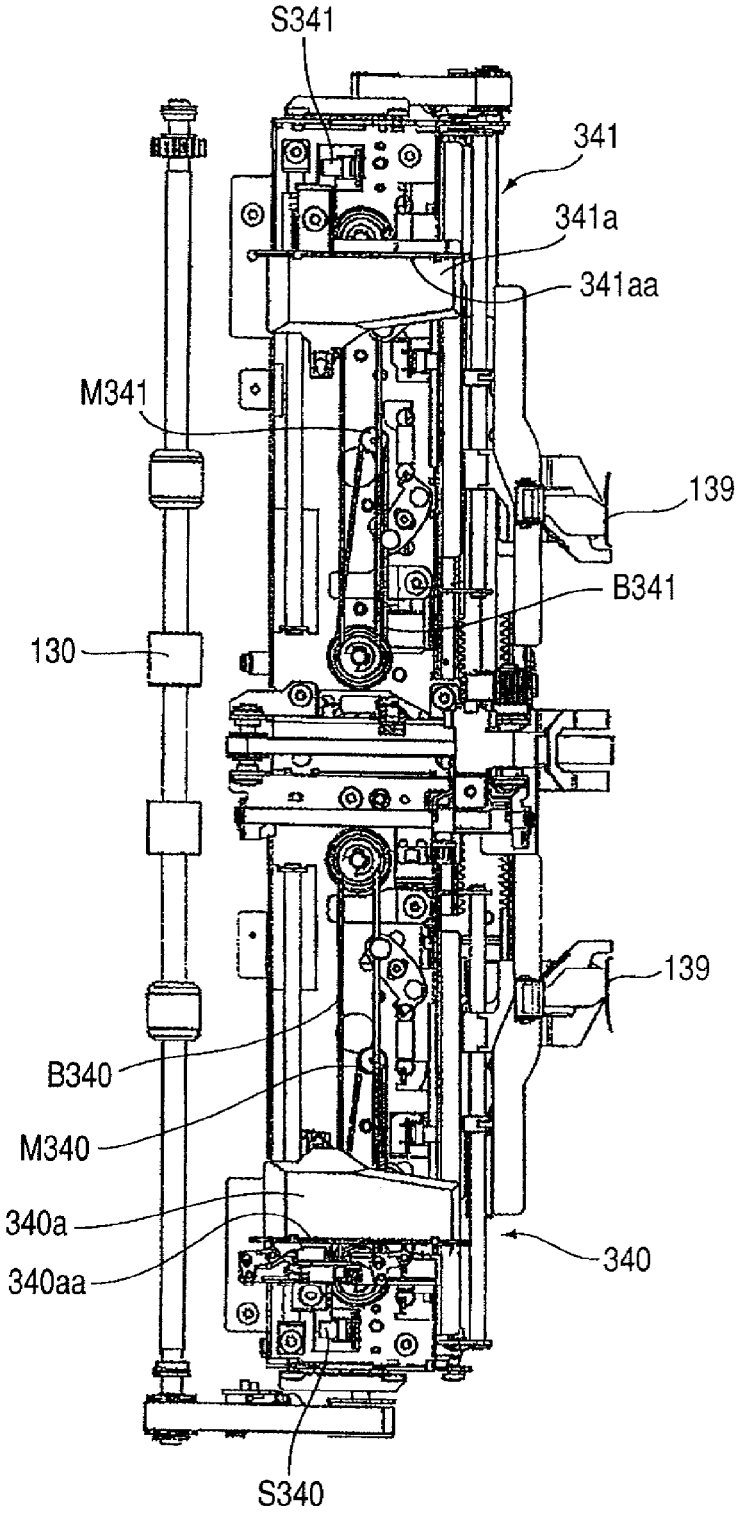
FIG. 10 is a plan view of the intermediate processing tray.

FIG. 7 is a diagram when the shift unit 108 is seen from the upstream side of the sheet conveying direction. FIG. 8 is a perspective view of the shift unit 108. It is assumed that the side of the shift unit 108 where a shift conveying motor 208 is provided becomes the front side of the finisher.

The shift conveying motor 208 rotates the shift roller pair 105 through a driving belt 209 and, further, rotates the shift roller pair 106 through a driving belt 213. A sheet P conveyed on the conveying path 103 as a conveying path from the apparatus main body 300A of the copying apparatus is conveyed in the direction shown by an arrow C by the shift roller pairs 105 and 106.

At this time, since the lateral registration detecting sensor 104 is moved in the direction shown by an arrow E by the driving source (not shown), a position (lateral registration error X) of the sheet P is detected. When a set job mode is a shift sorting mode, it is necessary to move the sheet during the conveyance by a shift amount Z ($Z=X+\alpha$) of the sheet obtained by adding a shift amount $\alpha$ of the sheet to the lateral registration error X. The shift sorting mode is a mode for shifting the sheet bundle in the width direction at the stacking position of the ejected sheets and sorting the sheet bundles. Such a shift movement is performed as follows: the sheet P is sandwiched between the shift roller pairs 105 and 106 and the shift unit 108 moves the shift roller pairs 105 and 106 in the front direction/back direction (between arrows D) from the center of the conveyance of the sheet width direction by a shift motor 210. By the shift movement, the sheet is shifted in the sheet width direction by a predetermined amount while being conveyed in the conveying direction C. If a non-sorting mode in which the shift movement is not performed is set, the sheet is conveyed in the state when it has been ejected to the outside of the apparatus main body 300A of the copying apparatus 300 and in the state where the sheet center in the width direction and the conveyance center are made coincident (center reference). The discharge position information is information regarding the conveying path, the shift position, and the like which are selected in accordance with the setting of the job mode. Standby positions of aligning members, which will be explained hereinafter, are changed on the basis of the discharge position information.

<Explanation of Insertion Sheet Feeding Apparatus>

An insertion sheet feeding apparatus 150 will now be described. The insertion sheet feeding apparatus 150 is an apparatus for directly inserting an insertion sheet to the intermediate processing tray 138 without executing the image forming operation. The insertion sheet feeding apparatus 150 is an apparatus for inserting a sheet such as cover, insert sheet, reverse/obverse sheet, or the like into an image forming sheet bundle, thereby enabling such a sheet to be saddle-stitched or side-stitched together with the sheet bundle. The insertion sheet feeding apparatus 150 in the embodiment conveys the insertion sheet in what is called a center reference state where the sheet center in the width direction and the conveyance center are made coincident.

In FIG. 2, the insertion sheet set on each of insertion feed trays 140 and 141 is fed to an inserting path 144 as a conveying path by pickup rollers 142 and 143. The fed insertion sheet passes through the inserting path 144 and meets in the buffer path 113. A width center of the insertion sheet after the meeting coincides with the conveyance center of the buffer path 113. If the insertion sheet is, for example, the cover, it is fed so that the timing for inserting it to the buffer path 113 coincides with the timing corresponding to the head of the sheet bundle. At this time, the apparatus main body 300A of the copying apparatus delays the image forming timing by the time corresponding to the insertion sheet until the meeting operation of the insertion sheet to the buffer path is finished, and conveys the sheet while keeping a sheet interval. If the insertion sheet is the insert sheet or the reverse/obverse sheet, the apparatus main body 300A of the copying apparatus also similarly conveys the sheet while keeping the sheet interval of the insertion sheets. Consequently, the insertion sheet is supplied at the timing matched with the sheet interval. All of those timing is monitored and controlled by response signals of sensors provided in the conveying path. A signal indicative of the selection of the conveying path which is outputted from the insertion sheet feeding apparatus 150 in response to an inserting command is used as discharge position information and the standby positions of the aligning members, which will be explained hereinafter, are controlled on the basis of the discharge position information.

<Explanation of Aligning System in Intermediate Processing Tray>

An aligning system will now be described with reference to FIGS. 9 to 14. A front sensor S340 side in FIGS. 9 to 14 is assumed to be a front side of the finisher 100. This is also a front side of the image apparatus main body 300A where the user stands toward the operation unit of the apparatus main body 300A.

A front aligning unit 340 and a back aligning unit 341 which serve as aligning means provided so as to sandwich the sheet have a set of front aligning member 340*a* and a back aligning member 341*a* for aligning left and right edge sides in the width direction (Y direction in the diagram) enclosed in the intermediate processing tray 138, respectively.

The front aligning member 340*a* and back aligning member 341*a* as aligning members are independently arranged at both side edges of the sheet P on the surface of the intermediate processing tray 138 so as to face each other. The front aligning member 340*a* and the back aligning member 341*a* have aligning surfaces 340*aa* and 341*aa* which press and align the side edges of the sheet and which are perpendicular to the surface of the intermediate processing tray 138, respectively.

The front aligning unit 340 and the back aligning unit 341 have a front driving motor M340 and a back driving motor M341 which construct driving units for independently driving, respectively. The front aligning member 340*a* and the back aligning member 341*a* can be independently moved along the width direction of the sheet to the intermediate processing tray 138 through a front timing belt B340 and a back timing belt B341 from front edge pulleys of the front driving motor M340 and the back driving motor M341.

That is, the aligning surface 340*aa* of the front aligning member 340*a* and the aligning surface 341*aa* of the back aligning member 341*a* are arranged on the processing tray 138 so as to face each other. Each moving mechanism is assembled to the lower surface side of the processing tray 138 so that the front aligning member 340*a* and the back aligning member 341*a* can be forwardly and reversely moved in the aligning direction.

The front sensor S340 and a back sensor S341 for detecting home positions of the front aligning member 340*a* and the back aligning member 341*a* are provided for the front and back aligning members 340*a* and 341*a*, respectively. When the front sensor S340 and the back sensor S341 are not operated, the front aligning member 340*a* and the back aligning member 341*a* are on standby at the home positions which have been set in both end portions of the processing tray 138, respectively. The standby positions of the front aligning member 340*a* and the back aligning member 341*a* are controlled on the basis of the discharge position information associated with the job mode which is transmitted to the finisher controller 36 from the CPU circuit unit 30 on the apparatus main body 300A side. Although the control of the standby positions of the front aligning member 340*a* and the back aligning member 341*a* is made through the finisher controller 36 in the embodiment, it is also possible to integratedly provide the finisher controller 36 for the CPU circuit unit 30 and directly make such control from the apparatus main body 300A side.

The operation of the aligning members in a sheet ejecting job will now be described.

First, the aligning operation which is executed by the front aligning unit 340 and the back aligning unit 341 in the case where there are no sheets on the intermediate processing tray 138, that is, when a first sheet P1 of the job is ejected to the intermediate processing tray 138 will be explained.

Figure 11:
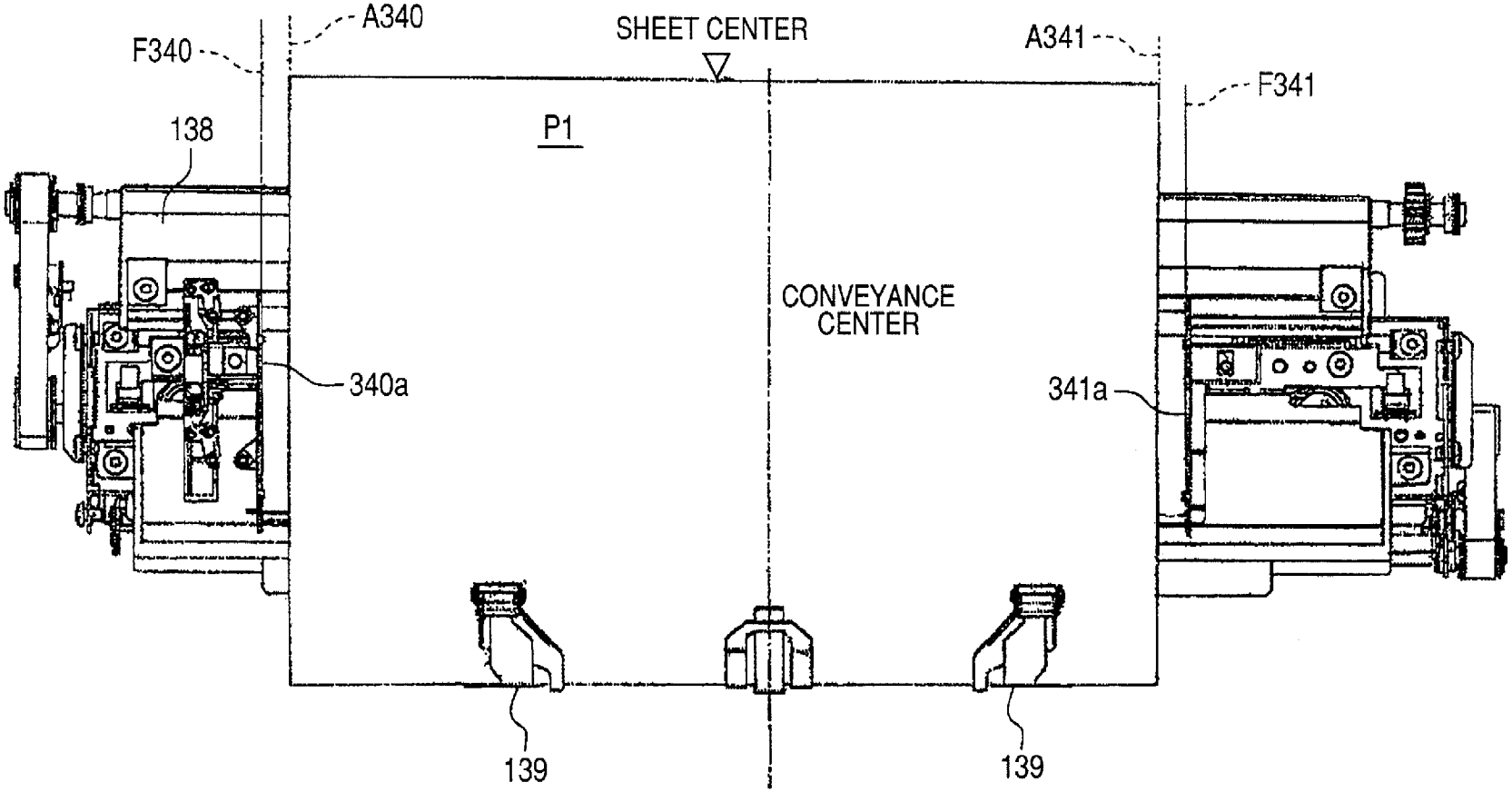
FIG. 11 is a diagram for explaining the operation in the case where the front aligning member and the back aligning member are located at standby positions in order to align the sheets which have passed through the shift unit.

If the job mode has been set to the shift sorting mode, as shown in FIG. 11, before the sheet is ejected from the lower discharge roller pair 128, the front aligning member 340*a* and the back aligning member 341*a* which have been on standby at the home positions are moved to the shift position where the sheet is ejected. If there are no sheets on the intermediate processing tray 138, ordinarily, the first sheet is shifted to the front side. However, if the previous ejecting job has been finished by the front-side shift, the sheet is shifted to the back side shift position. When the shift sorting mode is not set, the front aligning member 340*a* and the back aligning member 341*a* are on standby at the position matched with the conveyance center on the intermediate processing tray 138. Thus, the front aligning member 340*a* and the back aligning member 341*a* wait until the sheet is ejected in accordance with the shift position.

Figure 12:
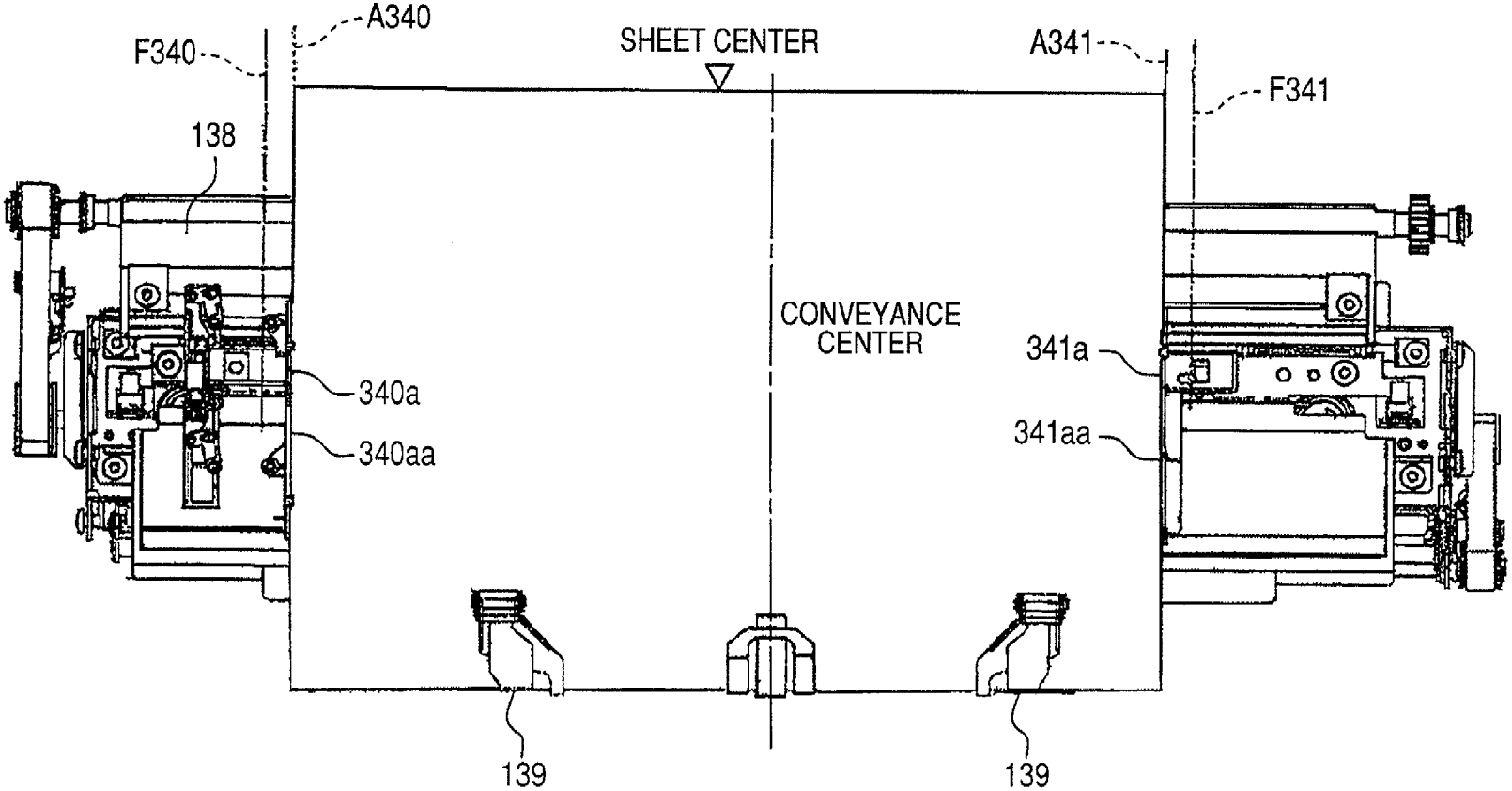
FIG. 12 is a diagram in the case where the front aligning member and the back aligning member have aligned the sheets which have passed through the shift unit.

At this time, the front aligning member 340*a* and the back aligning member 341*a* have been moved to standby positions F340 and F341 where they have slightly been shunted to the outsides of a width of sheet P1 (about 10 mm in the embodiment). The sheet is shifted by the shift unit 108 and the width center of the sheet and the conveyance center of the lower path 126 do not coincide as shown in FIG. 11 and FIG. 12. In this state, the rear edge of the sheet P1 ejected onto the intermediate processing tray 138 passes through a nip of the lower discharge roller pair 128 and collides against a rear edge stopper 139 by the counterclockwise rotation of the puddle 131.

After the collision of the sheet P1 was finished and the sheet came to rest, the front aligning member 340*a* and the back aligning member 341*a* which have been on standby at the standby positions F340 and F341 are moved to sheet aligning positions A340 and A341 where the sheet width is sandwiched as shown in FIG. 12. The aligning surfaces 340*aa* and 341*aa* collide against the side edges of the sheet due to the movement of the front aligning member 340*a* and the back aligning member 341*a*. Both side edges of the sheet are sandwiched at the aligning position of the sheet, thereby making the width alignment. The alignment of the width direction of the sheet denotes a process for aligning at least one side edge of the sheet along the conveying direction of the sheet. The side edge of the sheet is also an edge which crosses the sheet conveying direction.

The front aligning member 340*a* and the back aligning member 341*a* sandwich the sheet P1 at the sheet aligning positions A340 and A341 for a little while. After that, to prepare for the sheet P1 which is subsequently ejected, as shown in FIG. 11, the front aligning member 340*a* and the back aligning member 341*a* are returned again to the standby positions F340 and F341 where they have slightly been shunted to the outsides of the width of sheet P1.

At this time, the sheet P1 (the first sheet) which has previously been ejected remains at the sheet aligning position and only the front aligning member 340*a* and the back aligning member 341*a* are moved. Such a series of operations is repeated until the last sheet in the sheet bundle in the same job is conveyed from the lower discharge roller pair 128 and ejected onto the intermediate processing tray 138.

If the set job mode is a side-stitch mode, after the last sheet in the sheet bundle is ejected onto the intermediate processing tray 138, the stapler 132 binds the sheet bundle. The bundle discharge roller pair 130 ejects the sheet bundle onto the discharge tray 137. If the set job mode is a non-stitch shift sorting process, after the last sheet was aligned by the front aligning member 340*a* and the back aligning member 341*a*, the sheet bundle is ejected onto the discharge tray 137 in a lump by the bundle discharge roller pair 130.

If the set job mode is an output of a plurality of (two or more) print copies here or the next output job is started, before the head sheet in the next sheet bundle is ejected from the lower discharge roller pair 128, the front and back aligning members 340*a* and 341*a* are moved to the shift position where the sheet is ejected. The shift position in this case is a shift position on the side opposite to the first print copy or the just-precedent ejection completion job with respect to the conveyance center of the lower path 126. Thus, the front and back aligning members 340*a* and 341*a* enter the sheet ejection standby mode.

In this manner, in the finisher 100, the sheet bundles are stacked onto the discharge tray in the state where they are shifted and alternately deviated (offset) every sheet bundle or every different job. Thus, taking-out performance and sorting performance are improved. The offset amount in the embodiment is equal to about 30 mm by the conveyance center distribution of the lower path 126.

If the non-sorting mode has been set, the sheet is ejected onto the intermediate processing tray 138 in the state where the width center of the sheet and the conveyance center of the lower path 126 coincide (center reference). After that, the sheet is aligned by the front and back aligning members 340*a* and 341*a* in the state where the width center of the sheet and the conveyance center of the lower path 126 coincide. At this time, the front and back aligning members 340*a* and 341*a* are on standby at the standby positions where they are slightly shunted to the outsides of the sheet width. The standby positions of the front and back aligning members 340*a* and 341*a* are located at positions which are away from the conveyance center of the lower path 126 toward the front and back sides by an almost equal distance.

In this manner, the standby positions of the front and back aligning members 340*a* and 341*a* can be changed in accordance with the shift position of each sheet which is ejected from the sheet processing apparatus in which a plurality of shift positions can be set by the shift unit 108. The front and back aligning members 340*a* and 341*a* have slightly been shunted to the outsides of the width of the sheet P1 at their shift positions. It is, therefore, sufficient that the distance of the movement from the standby position to the sheet aligning position is the necessary minimum distance. Even if the shift positions are changed, the front and back aligning members 340*a* and 341*a* and the sheet which is ejected do not collide with each other and a time that is required for the sheet alignment is also reduced.

The operation in the case where the insertion sheet which has been fed from the insertion sheet feeding apparatus 150 to a position between the sheets which are sent from the apparatus main body 300A of the copying apparatus is ejected onto the intermediate processing tray 138 will now be described. First, it is assumed that the sheet bundle which is formed on the intermediate processing tray 138 is constructed by: the insertion sheet stacked as a cover of the sheet bundle onto the insertion feed tray 140 of the insertion sheet feeding apparatus 150; and the sheet as another middle sheet to which the toner image has been transferred by the apparatus main body 300A of the copying apparatus.

Figure 13:
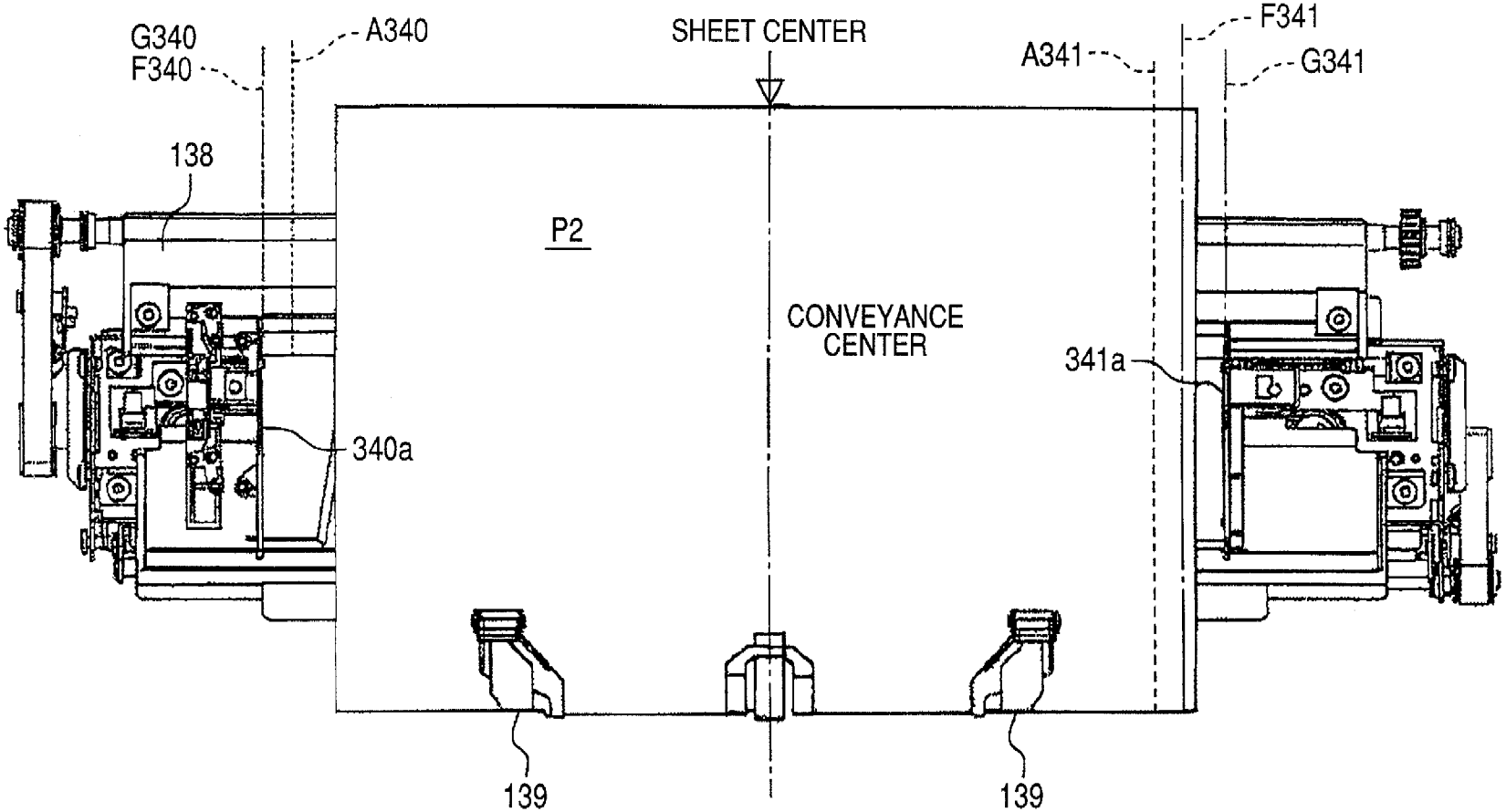
FIG. 13 is a diagram for explaining the operation in the case where the front aligning member and the back aligning member are located at standby positions in order to align an offset shift.

As shown in FIG. 13, the front and back aligning members 340*a* and 341*a* which were on standby at the home positions are moved to the ejecting position of the insertion sheet before an insertion sheet P2 fed from the insertion sheet feeding apparatus 150 is ejected from the lower discharge roller pair 128. The front and back aligning members 340*a* and 341*a* enter the state of waiting for the ejection of the insertion sheet on the basis of a detection signal of an insertion sheet detecting sensor 145 (refer to FIG. 2). The insertion sheet detecting sensor 145 is provided for the inserting path 144.

The standby positions upon ejection of the insertion sheet differ from the foregoing standby positions F340 and F341 at the time when the sheet ejected from the apparatus main body 300A of the copying apparatus is aligned. That is, the sheet ejected from the apparatus main body 300A is shifted in the width direction by the shift unit 108, so that the width center of the sheet and the conveyance center of the lower path 126 do not coincide as shown in FIG. 11 and FIG. 12. However, the insertion sheet P2 fed from the insertion sheet feeding apparatus 150 is ejected onto the intermediate processing tray 138 without passing through the shift unit 108 in the conveying step. Therefore, the width center of the insertion sheet and the conveyance center of the lower path 126 coincide as shown in FIG. 13. That is, the insertion sheet is ejected onto the intermediate processing tray 138 in the state of the center position (center reference). Thus, the standby positions of the front and back aligning members 340*a* and 341*a* for the insertion sheet differ from the standby positions F340 and F341 for the sheet ejected from the apparatus main body 300A.

As mentioned above, the front aligning member 340*a* and the back aligning member 341*a* are on standby at standby positions G340 and G341 where they have slightly been shunted to the outsides of the width of the insertion sheet P2.

In the case of the embodiment, the sheet bundle including the insertion sheet is aligned at the position where it has finally been shifted to the front side (the side of the front aligning unit 340). Therefore, the standby position G340 of the front aligning member 340*a* is set to the same position as the standby position F340 for the next second and subsequent sheets which are conveyed from the copying apparatus. However, the standby position G341 as a second standby position of the back aligning member 341*a* differs from the standby position F341 as a first standby position and is a position where it has slightly been shunted to the outsides with respect to the insertion sheet P2 which is ejected.

Figure 14:
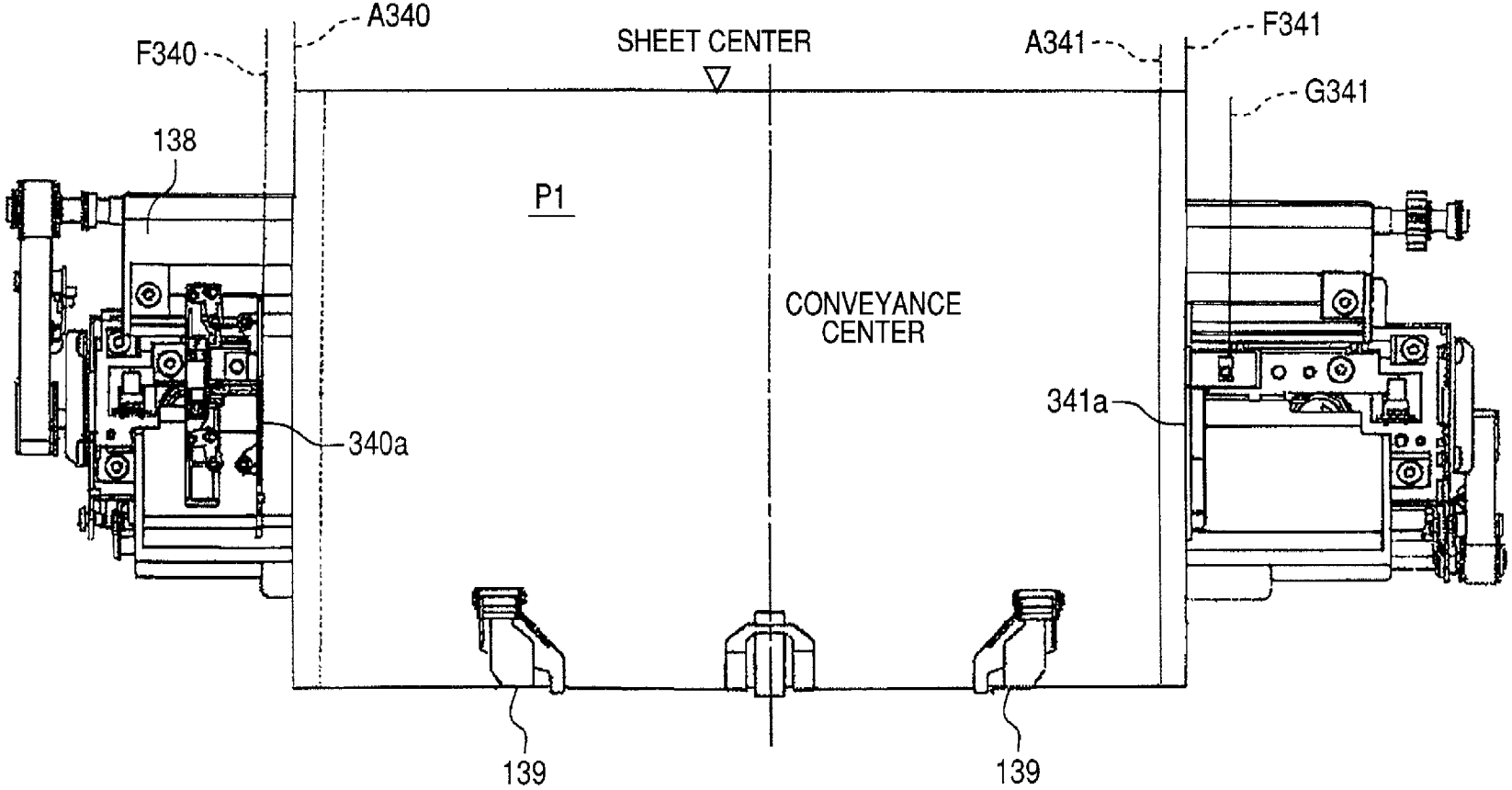
FIG. 14 is a diagram at the time when the back aligning member has been moved in order to align the offset shift.
Figure 15A:
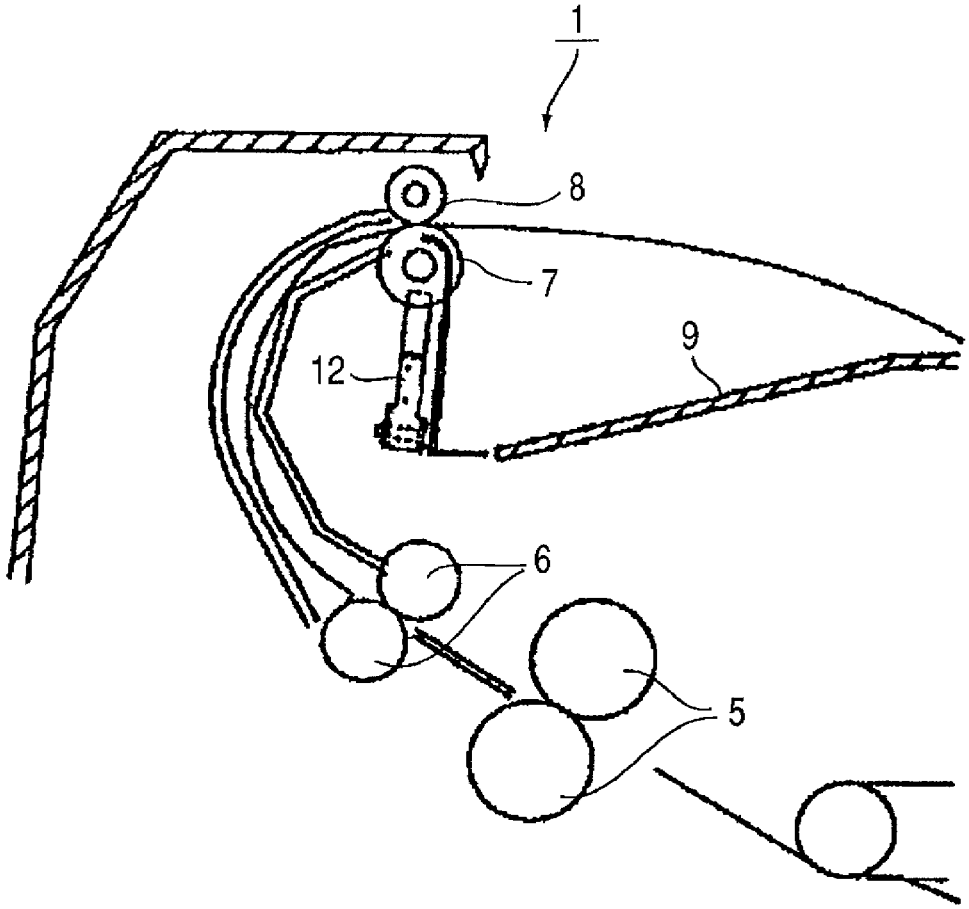
FIG. 15A is a front view of a conventional sheet processing apparatus.
Figure 15B:
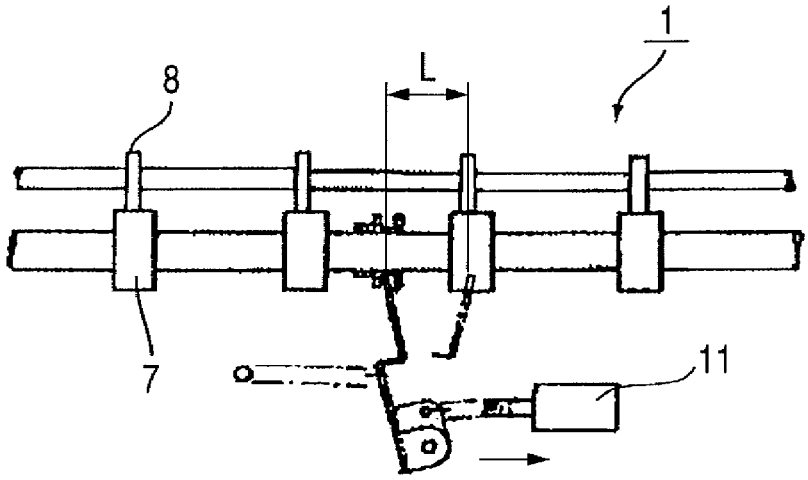
FIG. 15B is a right side elevational view of the conventional sheet processing apparatus.

In this state, the insertion sheet P2 passes through the nip position of the lower discharge roller pair 128 and the rear edge collides with the rear edge stopper 139 by the counterclockwise rotation of the puddle 131. The apparatus waits until the collision of the insertion sheet P2 is finished and the insertion sheet comes to rest. Only the back aligning member 341*a* on the opposite side which is shifted is moved to the standby position F341 for the sheet P1 which is conveyed from the apparatus main body 300A of the next copying apparatus. Thus, the insertion sheet P2 is preliminarily moved (pre-movement). After that, the front aligning member 340*a* and the back aligning member 341*a* which are on standby at the standby positions F340 and F341 wait until the sheet P1 which is conveyed from the apparatus main body 300A of the copying apparatus is ejected from the lower discharge roller pair 128 (FIG. 14).

The sheet P1 conveyed from the apparatus main body 300A of the copying apparatus passes through the nip position of the lower discharge roller pair 128 and the rear edge collides with the rear edge stopper 139 by the counterclockwise rotation of the puddle 131. The apparatus waits until the collision of the sheet P1 is finished and the sheet comes to rest. The front and back aligning units 340 and 341 which were preliminarily on standby at the standby positions F340 and F341 where they have slightly been shunted to the outsides of the sheet width are moved to the sheet aligning positions A340 and A341 where the sheet width is sandwiched.

The aligning surfaces 340*aa* and 341*aa* collide with the side edges of the sheet P1 and the insertion sheet P2 by the movement of the front aligning member 340*a* and the back aligning member 341*a* and both side edges of the sheet is sandwiched at the aligning position of the sheet, thereby aligning. The front aligning member 340*a* and the back aligning member 341*a* sandwich the sheet P1 at the sheet aligning positions A340 and A341 for a little while. After that, to prepare for the sheet P1 which is subsequently ejected, as shown in FIG. 11, the front aligning member 340*a* and the back aligning member 341*a* are returned again to the standby positions F340 and F341 where they have slightly been shunted to the outsides of the width of sheet P1.

The aligning operation of the sheet P1 is executed in a manner similar to the aligning operation of the sheet which is conveyed from the apparatus main body 300A of the copying apparatus. Such a series of operations is repeated until the last sheet in the sheet bundle in the same job is ejected from the lower discharge roller pair 128 and ejected onto the intermediate processing tray 138.

If the set job mode is a side-stitch mode, after the last sheet in the sheet bundle is ejected onto the intermediate processing tray 138, the stapler 132 binds the sheet bundle. The bundle discharge roller pair 130 ejects the sheet bundle onto the lower tray 137. If the set job mode is the non-stitch shift sorting process, after the last sheet was aligned by the front aligning member 340*a* and the back aligning member 341*a*, the sheet bundle is ejected onto the discharge tray 137 in a lump by the bundle discharge roller pair 130.

If the set job mode is setting of the output of a plurality of print copies here or if it is a continuous job in which the next job is subsequently outputted, the sheet bundle is stacked onto the discharge tray 136 while alternately deviating the shift positions to the front and back positions in a manner similar to the foregoing operation.

In the above explanation, at a point of time when the job mode has been set, the front aligning member 340*a* and the back aligning member 341*a* change the standby positions. That is, the finisher 100 previously changes the standby positions on the basis of the discharge position information regarding the designation of the conveying path, presence or absence of the shift, and the like associated with the set job mode. As a trigger of the change in standby positions, the standby positions can be also changed on the basis of the sheet detecting operation of the insertion sheet detecting sensor 145. In other words, generally, the standby positions of the front aligning member 340*a* and the back aligning member 341*a* are set in accordance with the sheet which is conveyed on the conveying path 103 from the apparatus main body 300A. Only when the insertion sheet detecting sensor 145 is made operative, the standby positions are changed to the standby positions according to the insertion sheet.

In the above description, as a path for conveying the sheet to the intermediate processing tray 138, there are two paths of the conveying path 103 and the inserting path 144. However, three or more paths may be provided. If there are N paths, the shift units 108 of the number within a range from 1 to (N−1) may be provided.

As mentioned above, the embodiment has been shown with respect to the example in which the insertion sheet is fed from the insertion sheet feeding apparatus 150. However, even in the case of the sheet which passes through the shift unit 108, with respect to the sheet which is not shifted, the same aligning operation as that in the case from the insertion sheet feeding apparatus 150 is executed. Although the embodiment has been described with respect to the construction in which the shift unit is provided only for the conveying path from the apparatus main body 300A, the shift unit can be also provided for the conveying path from the insertion sheet feeding apparatus 150.

In the case where the standby positions of the front aligning member 340*a* and the back aligning member 341*a* are set to the positions where a degree of freedom is further raised and they can be moved, even if a plurality of different sheet processing apparatuses are coupled between the copying apparatuses, the conveying path becomes long, and an oblique motion or an oblique conveyance of the sheet occurs, the sheets can be sufficiently aligned.

Further, according to the sheet processing apparatus of the invention, the alignment can be performed by changing the standby positions of the front aligning member 340*a* and the back aligning member 341*a* even if the sheet is any of the sheet which has passed through the shift unit 108 and the sheet which does not pass.

If it is assumed that the standby positions of the front aligning member 340*a* and the back aligning member 341*a* cannot be changed, the following inconvenience occurs in order to avoid the collision among the ejected sheet and the front aligning member 340*a* and the back aligning member 341*a*. That is, the insertion sheet supplied from the insertion sheet feeding apparatus has to be reversely conveyed to the shift unit 108 from a meeting point GP of the inserting path 144 and the conveying path 103 and has to be shift-adjusted in a manner similar to the sheet which passes through the shift unit 108. Subsequently, the conveying direction is changed again and the sheet is conveyed to the intermediate processing tray 138. Since the insertion sheet is switch-back conveyed, the conveyance control of the sheet becomes complicated and processing efficiency of the sheet deteriorates. Further, since the insertion sheet is switch-back conveyed, in FIG. 2, an interval between the meeting point GP of the inserting path 144 and the conveying path 103 and the shift unit 108 has to be set to the longest length of the insertion sheet. For example, the maximum sheet conveyance length is equal to 420 mm corresponding to the length of sheet of the A3 size. Consequently, a size of finisher 100 increases. Although a method whereby the insertion sheet is fed from the upstream side of the shift unit 108 is also considered to avoid such a problem, another problem in which the setting position of the insertion sheet feeding apparatus is limited occurs.

However, according to the sheet processing apparatus of the invention, since the standby positions of the front aligning member 340*a* and the back aligning member 341*a* can be changed, there is no need to reversely convey the insertion sheet to the shift unit and the setting position of the insertion sheet feeding apparatus is not limited either.

That is, according to the sheet processing apparatus of the invention, the shift unit 108 is provided in the conveying path 103 and even if the inserting path 144 from the insertion sheet feeding apparatus 150 meets on the downstream side of the shift unit, processing productivity of the sheets does not deteriorate. Aligning precision can be also improved.

As mentioned above, according to the sheet processing apparatus of the invention, even if various option apparatuses are connected, the stable alignment can be performed. The embodiment has been described with respect to the construction in which the standby positions of the front aligning member 340*a* and the back aligning member 341*a* are changed for the sheet from the conveying path with the shift unit having the shifting function and for the sheet from the conveying path without the shift unit. However, the invention is not limited to such a construction but is also effective, for example, to the case where an image forming apparatus of a one-side reference in which the side edge in the width direction which crosses the conveying direction of the sheet is set to a reference and the option apparatus of the center reference in which the center of the sheet width is set to a reference are connected.

Further, according to the sheet processing apparatus of the invention, since the standby positions of the front aligning member 340*a* and the back aligning member 341*a* can be changed, the sheet can be stably shifted even in the case of a sheet such as thick tear-resistant paper or the like or a bent sheet conveying path. Moreover, the shifting operation can be executed in the state where the lateral registration deviation of the sheet occurring in the apparatus main body of the copying apparatus or in its downstream unit has been corrected by the shift unit 108. Therefore, the sheets can be easily stacked so as to enter the state where they have been aligned on the intermediate processing tray 138, and the aligning precision can be raised.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2005-348548, filed Dec. 1, 2005, and No. 2006-270798, filed Oct. 2, 2006, which are hereby incorporated by reference herein in their entirety.

What is claimed is:

1. A sheet processing apparatus comprising:

a first conveying path through which a sheet is conveyed;

a second conveying path through which a sheet is conveyed;

a stacking tray on which the sheets conveyed from said first and second conveying paths are stacked; and an aligning unit which has a pair of aligning members which come into contact with the side edges of the sheets and aligns side edges in a width direction which crosses a sheet conveying direction of the sheets stacked on said stacking tray by movement in the width direction from a standby position where said pair of aligning members are arranged in the outside of the sheets in the width direction to an aligning position where the sheets are aligned, wherein the sheet conveyed from said first conveying path is discharged on a first discharge position of said stacking tray in the width direction, wherein the sheet conveyed from said second conveying path is discharged on a second discharge position of said stacking tray in the width direction, which is different from said first discharge position, and wherein said standby position is dependent on whether a sheet is discharged on said first discharge position or said second discharge position.

2. An apparatus according to claim 1, wherein said standby position is different for every sheet discharged on said stacking tray.

3. An apparatus according to claim 1, further comprising a shift unit which is provided for at least one of said first and second conveying paths and moves a sheet which is conveyed on said conveying path in the width direction, wherein said standby position is changed in accordance with the position of the sheet shifted by said shift unit.

4. An apparatus according to claim 3, wherein said aligning unit has a driving unit which independently moves said pair of aligning members, and wherein, in said pair of aligning members, said standby position of the aligning member on the side opposite to the direction where said shift unit moves the sheet can be changed.

5. An apparatus according to claim 1, wherein said aligning unit has a driving unit which independently moves said pair of aligning members, and wherein, in said pair of aligning members, said standby position of one of the aligning member is same, and the other can be changed in accordance with each discharge position.

6. An apparatus according to claim 1, further comprising an insertion sheet feeding apparatus which supplies a sheet is connected to at least one of said first and second conveying paths.

7. An image forming apparatus comprising:

an image forming portion which forms an image onto a sheet;

a sheet processing portion including:

a first conveying path through which a sheet is conveyed;

a second conveying path through which a sheet is conveyed;

a stacking tray on which the sheets conveyed from said first and second conveying paths are stacked; and an aligning unit which has a pair of aligning members which come into contact with the side edges of the sheets and aligns side edges in a width direction which crosses a sheet conveying direction of the sheets stacked on said stacking tray by movement in the width direction from a standby position where said pair of aligning members are arranged in the outside of the sheets in the width direction to an aligning position where the sheets are aligned, wherein the sheet conveyed from said first conveying path is discharged on a first discharge position of said stacking tray in the width direction, wherein the sheet conveyed from said second conveying path is discharged on a second discharge position of said stacking tray in the width direction, which is different from said first discharge position, and wherein said standby position is dependent on whether a sheet is discharged on said first discharge position or second discharge position.

8. An image forming apparatus as claimed in claim 7, further comprising an insertion sheet feeding apparatus which supplies a sheet is connected to at least one of said first and second conveying paths.

9. An image forming apparatus as claimed in claim 7, wherein said standby position is different for every sheet discharged on said stacking tray.

10. An image forming apparatus as claimed in claim 7, further comprising a shift unit which is provided for at least one of said first and second conveying paths and moves a sheet which is conveyed on said conveying path in the width direction of the sheet, wherein said standby position is changed in accordance with the position of the sheet shifted by said shift unit.

11. An image forming apparatus as claimed in claim 7, wherein said aligning unit has a driving unit which independently moves said pair of aligning members, and wherein, in said pair of aligning members, said standby position of one of the aligning member is same, and the other can be changed in accordance with each of said first and second discharge position.

12. A sheet processing apparatus comprising:

a first conveying path through which a sheet supplied is conveyed from a first sheet feeding apparatus;

a second conveying path through which a sheet supplied is conveyed from a second sheet feeding apparatus;

a stacking tray on which the sheets conveyed from said first and second conveying paths are stacked; and an aligning unit which has a pair of aligning members which come into contact with the side edges of the sheets and aligns side edges in a width direction which crosses a sheet conveying direction of the sheets stacked on said stacking tray by movement in the width direction from a standby position where said pair of aligning members are arranged in the outside of the sheets in the width direction to an aligning position where the sheets are aligned, wherein the sheet conveyed from said first conveying path is discharged on a first discharge position of said stacking tray in the width direction, wherein the sheet conveyed from said second conveying path is discharged on a second discharge position of said stacking tray in the width direction, which is different from said first discharge position, wherein when said pair of aligning members align the side edges of the sheets conveyed from said first conveying path, the standby position of said pair of aligning members is a position in accordance with the first discharge position, and wherein when said pair of aligning members align the side edges of the sheets conveyed from said first and second conveying paths, the standby position of one of the aligning members is the position in accordance with the first discharge position, and the standby position of the other is changed in accordance with each of said first and second discharge position.

13. An apparatus according to claim 12, wherein the first sheet feeding apparatus is an image forming apparatus which forms an image onto a sheet, and the second sheet feeding apparatus is an insertion sheet feeding apparatus which supplies an insertion sheet.

14. An apparatus according to claim 12, further comprising a shift unit which is provided for at least one of said first and second conveying paths and moves a sheet which is conveyed on said conveying path in the width direction, wherein said standby position is changed in accordance with the position of the sheet shifted by said shift unit.

15. An apparatus according to claim 12, wherein said aligning unit has a driving unit which independently moves said pair of aligning members.

* * * * *